United States Patent [19]

LaPrad et al.

[11] 3,951,684

[45] Apr. 20, 1976

[54] LIQUID DISTRIBUTION SYSTEM FOR DISHWASHER

[75] Inventors: Paul J. LaPrad, St. Joseph; Chester W. Wassilak, Benton Harbor; Philip P. Johnson, St. Joseph, all of Mich.

[73] Assignee: Whirlpool Corporation, Benton Harbor, Mich.

[22] Filed: Aug. 5, 1974

[21] Appl. No.: 494,894

[52] U.S. Cl. ..... 134/144; 134/148; 134/176; 239/251; 277/34.6

[51] Int. Cl.[2] ..... B08B 3/02

[58] Field of Search ..... 134/176, 179, 144, 148, 134/24, 167 C, 168 C; 239/251; 277/34.6

[56] References Cited

UNITED STATES PATENTS

| | | | |
|---|---|---|---|
| 1,893,979 | 1/1933 | Barrere | 134/167 C X |
| 3,064,664 | 11/1962 | Warhus | 134/176 |
| 3,444,870 | 5/1969 | Lyman | 134/179 |
| 3,722,895 | 3/1973 | Mevissen | 277/34.6 X |
| 3,785,566 | 1/1974 | Jenkins | 134/179 X |

FOREIGN PATENTS OR APPLICATIONS

| | | | |
|---|---|---|---|
| 1,628,601 | 8/1970 | Germany | 134/176 |

*Primary Examiner*—Robert L. Bleutge
*Attorney, Agent, or Firm*—Hill, Gross, Simpson, Van Santen Steadman, Chiara & Simpson

[57] ABSTRACT

A fluid delivery system for a dishwashing appliance of the type having movable upper and lower racks and upper and lower spray arms has a telescoping tower in fluid communication with a manifold during operation. A face seal between the upper spray arm and the telescoping portion of the tower is effected upon buildup of fluid pressure in the tower sufficient to bring the telescoping portion into engagement with the upper spray arm and thereby deliver wash liquid to the upper spray arm. A generally axially-extending seal actuated by the fluid pressure in the tower seals the telescoping portion to the fixed portion of the tower during delivery of wash liquid through the fluid conduit system. When the pumping of the wash liquid is terminated, the telescoping portion of the tower automatically retracts.

6 Claims, 6 Drawing Figures

LIQUID DISTRIBUTION SYSTEM FOR DISHWASHER

REFERENCE TO RELATED APPLICATION

This application has features in common with the copending application of Wilbur W. Jarvis, Jr. and Leslie Toth, Ser. No. 494,893, filed concurrently herewith and assigned to the same assignee as the present application.

BACKGROUND OF THE INVENTION

1. Field of the Invention

This invention is in the field of dishwashing machines and is particularly concerned with a liquid distribution system for delivering wash liquid concurrently to each of two spray arms during the washing operation, the distribution system being automatically disengaged upon termination of wash liquid circulation to provide more convenient access to the dish racks located within the appliance.

2. Description of the Prior Art

Automatic dishwashing machines including a pair of rotating spray arms, one located below the upper dish rack and the other below the lower dish rack are, of course, old. There are numerous examples of this type of machine in United States patents and a few of these are summarized below.

Zurek U.S. Pat. No. 3,009,470 describes a dishwashing apparatus in which there is provided a stationary supply conduit which receives the lower portion of a beveled rotating hub. The hub is mounted on a pivot bearing which extends upwardly from the conduit into cooperative relation with a bearing provided in the hub. The bearing elements are arranged so that under maximum deflection of the hub during its rotation, there is no contact of the edge of the hub with the surface of the conduit. The principal objective of this disclosure was to provide a low friction, substantially clog-proof means for rotatably mounting a reaction type spray device on a conduit supplying the device with liquid under pressure.

Warhus U.S. Pat. No. 3,064,664 provides a dishwashing machine with means for automatic coupling of the fluid supply conduit to the lower spray arm when the lower rack is in operative position. This patent disclosure suggests utilizing an annular expansion coupling fixed about the axial discharge opening provided by the open upper end of the hub portion of the lower spray arm. With an arrangement of this type, the spray arm becomes automatically detached from the liquid supply when the supply means is cut off.

Jenkins U.S. Pat. No. 3,785,566 describes an automatic dishwashing machine in which the pump outlet is provided with a seal member which expands into sealing engagement with the spray arm in response to the delivery of pressurized washing liquid therethrough.

SUMMARY OF THE INVENTION

The apparatus of the present invention provides a fluid distribution system for a dishwashing appliance having an upper and lower rack with a spray device associated with each. An expansible coupling member provides fluid communication between the pump outlet manifold and a tower mounted on the lower dish rack. The tower is a telescoping tower including a lower or fixed tower portion and an upper portion telescoped therein in sliding relation. An annular seal is provided between the telescoping portion and the fixed portion of the tower to prevent liquid from escaping between the two portions of the tower when the tower is in its extended position as a result of fluid flow therethrough. The seal expands against the inner sidewall of the fixed portion of the tower in response to fluid flow through the tower to provide a seal between the tower portions. In the absence of fluid flow, the seal collapses to permit the movable portion of the tower to slide downwardly within the fixed portion without hindrance from the seal. The seal is made of a resilient material and is held in a pair of axially spaced grooves located at the lower end of the movable tower portion.

The upper end of the movable tower portion is flared and has an upwardly facing opening at the base of the flared portion to permit liquid discharge from the tower. A hub or manifold assembly including a support which grips the upper rack, a hub or manifold which mounts the upper spray arm, and a coupling member attached to the lower end of the hub receives liquid from the tower and passes it to the hollow upper spray arm. The opening in the upper end of the movable tower portion is of such a size that the force of liquid against the top of the movable tower portion is sufficient to raise it into contact with the coupling member. Liquid then passes through the opening into the coupling member, expanding the coupling member through liquid pressure into sealing engagement with the flared upper portion of the tower.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
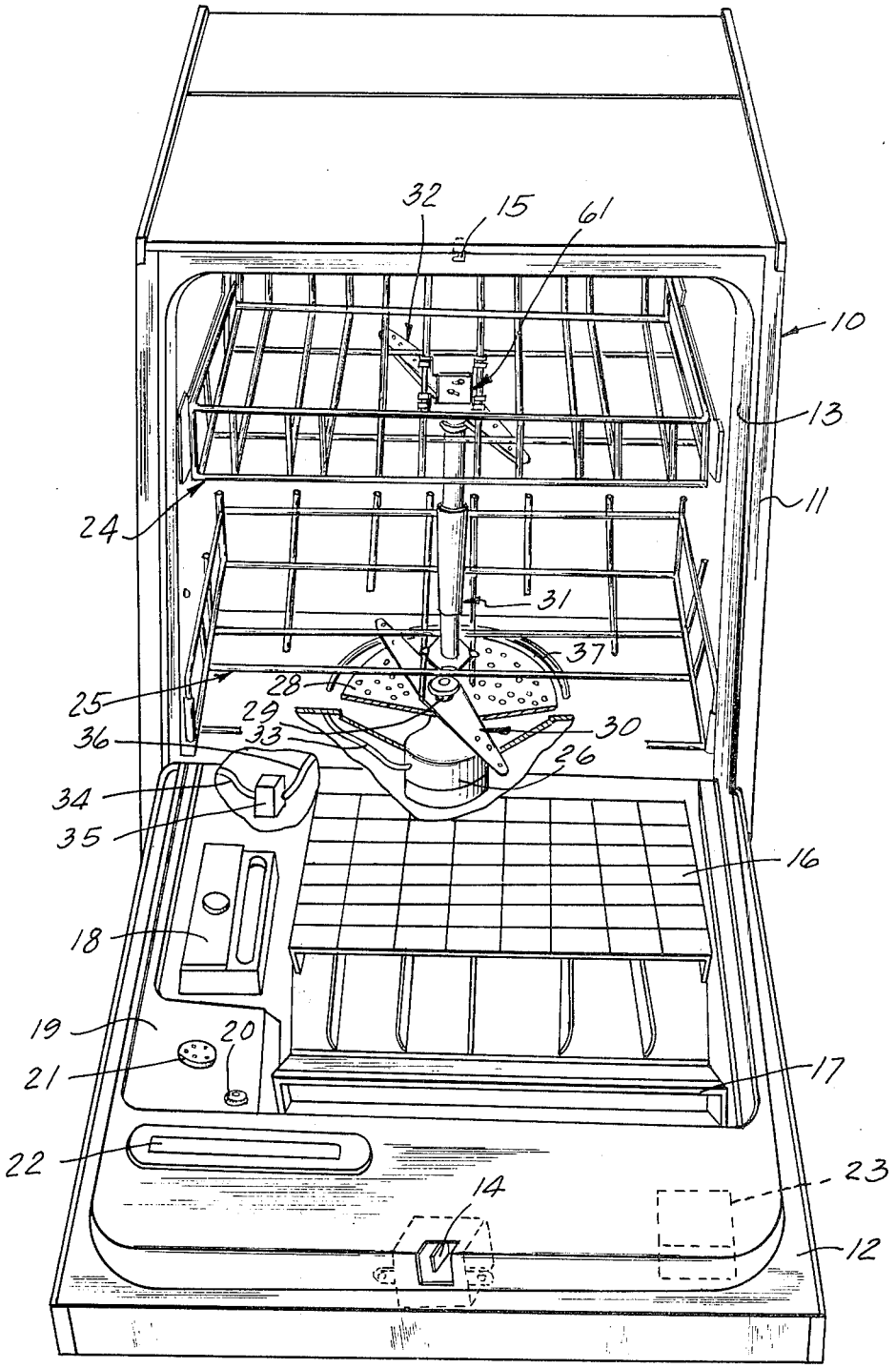
FIG. 1 is a view in perspective, partly broken away to better illustrate the interior construction thereof, of a dishwashing appliance of the type with which the present invention is concerned.

In FIG. 1, reference numeral 10 has been applied generally to a two-rack dishwashing appliance of the front loading type. The dishwasher 10 includes a cabinet 11 which hingedly supports a door 12. A sealing gasket 13 is provided about the entire periphery of the opening of the cabinet and cooperates with the door 12 to seal the interior of the cabinet when the door is closed. The door 12 is provided with a latching mechanism 14 which is arranged to engage a strike 15 for releasably latching the door 12 to the cabinet 11 when the door is in the closed position.

The inner panel of the door 12 carries baskets 16 and 17 for receiving silverware and other small objects to be washed. A detergent dispenser 18 and a rinse additive dispenser 19 provided with a filling cap 20 and a discharge opening 21 are also provided on the door 12. A vent opening 22 is provided to direct the moisture laden air from the machine during the drying cycle. A timer 23 is positioned in the door to control the programmed cycles of filling, washing, draining, rinsing, drying, and dispensing the detergent and rinse additives in timed sequence.

The machine includes a pair of dish-supporting racks, including an upper dish-supporting rack generally indicated at numeral 24 and a lower dish-supporting rack indicated at reference numeral 25. Wash liquid is pumped through the machine by means of a pump 26 driven by a motor 27, both of these elements being disposed in a depressed sump area provided in the floor of the cabinet. A filter screen 28 is provided to trap foreign particles and to prevent their circulation with the wash liquid.

The pump 26 has two pump chambers, one of which provides wash liquid under pressure through an outlet manifold assembly 47 including a hub 29 to a lower spray device 30 and also to a liquid distribution means 31 which delivers wash liquid to an upper spray arm 32. The other pump chamber of the pump 26 pumps the wash liquid, during a drain-out or pump-out portion of the cycle, through a discharge conduit 33 into a discharge conduit associated with the dishwasher. Water enters the washing chamber through a conduit 34 which is under the control of a water inlet control valve 35. The control valve 35 is connected by a hose 36 to a suitable source of pressurized water. A heating element 37 may be provided in the chamber to heat the washing liquid during the wash cycle and to heat the air within the chamber during a drying cycle.

Figure 6:
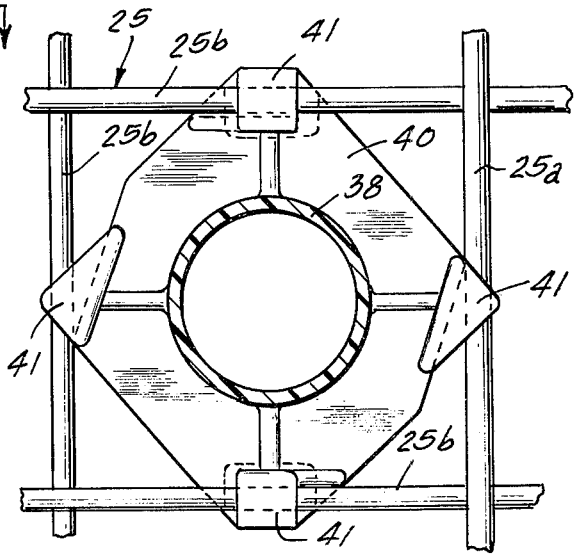
FIG. 6 is a view taken along the line VI—VI of FIG. 2.

The improvements of the present invention are largely centered around the liquid distribution means identified generally at reference numeral 31. It will be seen by reference to FIG. 3 that this liquid distribution means includes a fixed tower portion 38 and a telescoping portion 39 which is slidably received therein. The two portions are shown in the collapsed position of the fluid transmitting system in FIG. 2 and in the extended position in FIG. 3. The fixed portion 38 is firmly but detachably secured to the bottom of the lower dish rack 25 as best seen in FIG. 6 of the drawings. As seen in that figure, there is provided a polygonal plate 40 which carries at its corners a plurality of gripping means 41 which are provided with hook-like portions or the like (not shown) which engage the wires 25*a* and 25*b* of the lower dish rack 25 from both above and below the wires. The polygonal shape of the plate 40 permits the plate to be inserted between the intersecting wires so that a rotation of about 90° will cause the gripping means 41 to securely engage the wires 25*a* and 25*b*.

Figure 2:
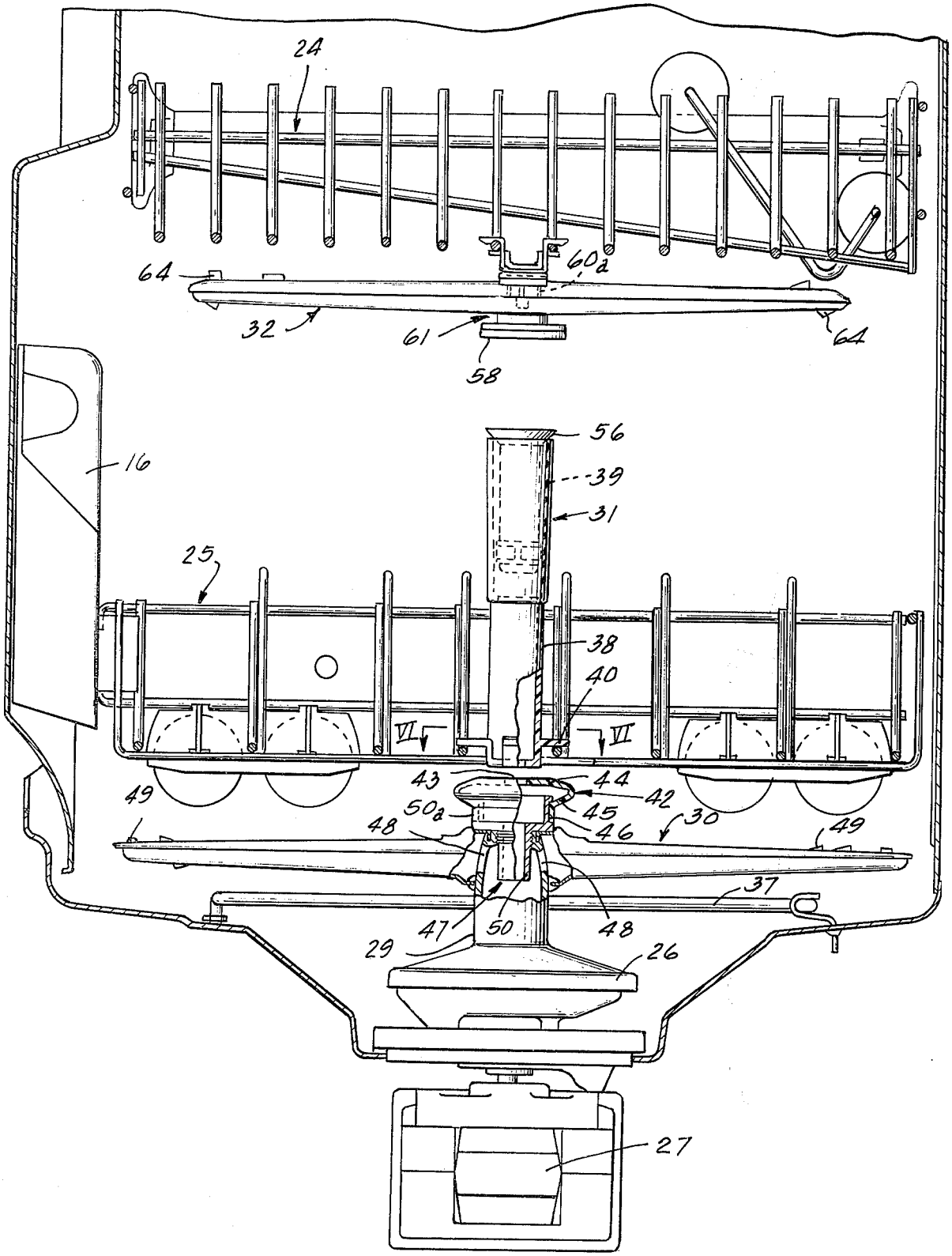
FIG. 2 is a view partly in elevation and partly in cross-section of the dishwashing appliance of FIG. 1, showing the elements of the fluid distribution system in their uncoupled condition.

Referring specifically to FIG. 2, a coupling member 42 composed of a resilient heat and liquid resistant material such as neoprene is coupled to the outlet manifold assembly 47. The coupling member 42, at its upper end, is provided with an aperture 43 of somewhat lesser diameter than the opening at the bottom of the fixed tube portion 38 of the tower structure. The aperture 43 is formed in an upper wall 44 of the expansible coupling member 42 which has a thickness relatively large in comparison to the thickness of the sidewall 45 and the neck 46 of the coupling member 42. This difference in thickness insures that when pressurized wash liquid flows into the coupling member 42, the relatively thin wall 45 will flex to an extended or pressurized position and move wall 44 upwardly without distortion into sealing contact with the open lower end of the fixed outer portion 38.

A portion of the fluid discharge of the pump 26 is directed from the hub 29 through a plurality of apertures 48 in the hub sidewall radially outwardly into the interior of the hollow spray arm 30. A plurality of flow-directing nozzles 49 are located on the spray arm 30 to form a predetermined flow pattern for the wash liquid issuing from the nozzles during rotation of the spray arm 30. Flow of the wash liquid through the nozzles 49 rotates the spray arm 30 about its axis due to the reaction forces of the liquid being discharged through the nozzles 49.

The pump outlet manifold assembly also includes a nozzle means 50a, and a portion of the wash liquid discharged by the pump 26 passes through a tube portion 50 of the nozzle means 50*a* and into the coupling member 42 carried by the nozzle means where it urges the upper wall 44 upwardly into sealing contact with the lower portion of the tower 38. Pressurized wash liquid is then directed through the tower into the upper spray arm 32 in a manner about to be described.

Figure 3:
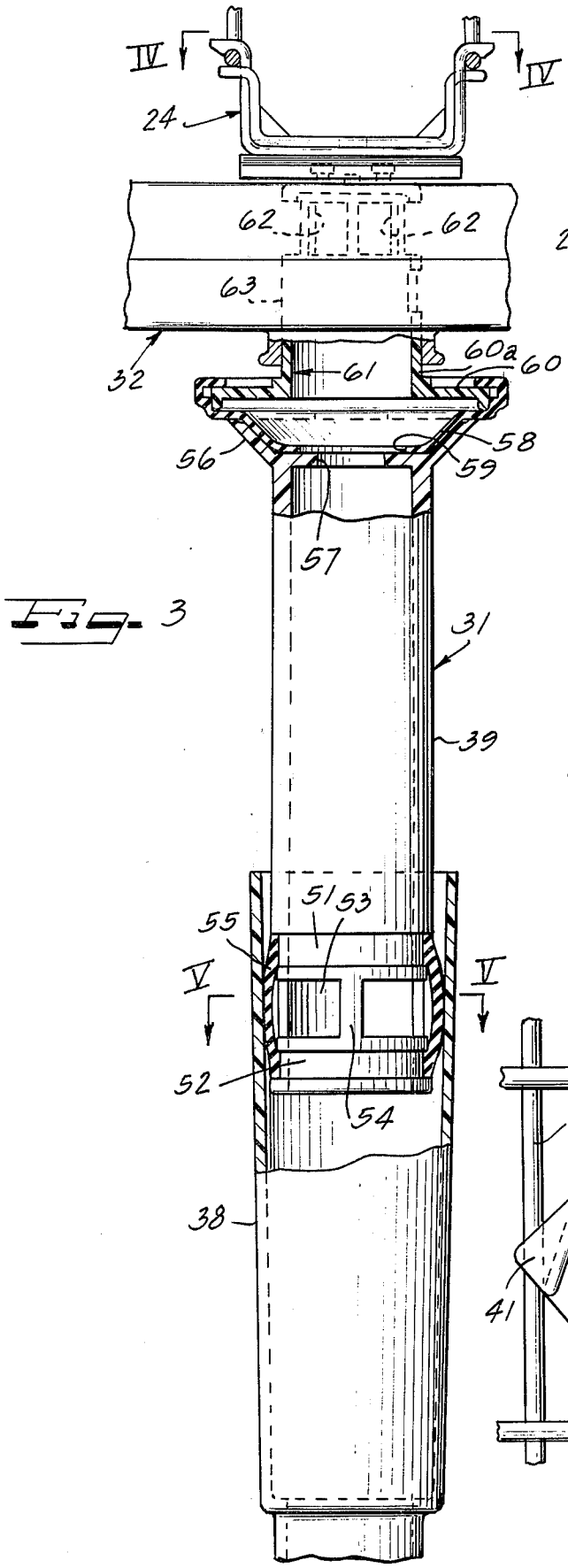
FIG. 3 is a fragmentary view partly in elevation and partly in cross-section of the telescoping tower arrangement.

Turning now to the specifics of the tower construction, it will be seen, particularly in FIG. 3, that the lower end of the telescoping hollow portion 39 is provided with a pair of axially spaced circumferential grooves 51 and 52 near its lower end. Between the grooves are a plurality of apertures 53 partially defined in the sidewall of portion 39 by a series of vertical ribs 54. The apertures 53 communicate the fluid pressure within the telescoping portion 39 to a flexible sealing collar or resilient sealing member 55 which has its opposite end portions received and retained within the grooves 51 and 52, respectively. When there is no pressure differential acting against the sealing member 55, the natural resilience of the sealing member 55 urges it closely against the periphery of the end portion of the telescoping portion 39. When, however, the fluid pressure of the wash liquid is sufficient to raise the telescoping section 39 to the position indicated in FIG. 3 so that the tower comes into engagement with the upper spray arm 44 (as will be described hereinafter) continued application of the pressure causes the sealing member 55 to expand or bow outwardly as indicated in FIG. 3 to form a seal against the inner periphery of the fixed tower portion 38.

The upper end of the telescoping tower portion 39 is flared as indicated at reference numeral 56. Formed within the upper end of the telescoping portion is an aperture 57. The upper flared portion 56 is arranged to be received in sealing engagement against a flexible diaphragm seal or gasket 58 having an aperture 59 therein which is in registry with the aperture 57. The gasket 58 is received about a flange portion 60 of a manifold or hub member 60*a*, and the hub member 60*a* is part of a hub or manifold support assembly generally indicated at reference numeral 61. It will be noted that the aperture 57 is of smaller diameter than the aperture 59 in the gasket 58. The aperture 57 is sized such that the force of liquid against the top of the movable tower portion 39 is sufficient to raise it into contact with the gasket 58. The fluid then passes through the hollow hub 60*a* and is directed into the interior of the hollow spray arm 32 through spaced apertures 62. A bearing surface 63 is provided on the hub 60a about which the upper spray arm 32 rotates by virtue of the reaction forces produced by water exiting through the nozzles 64 shown in FIG. 2 of the drawings.

Figure 4:
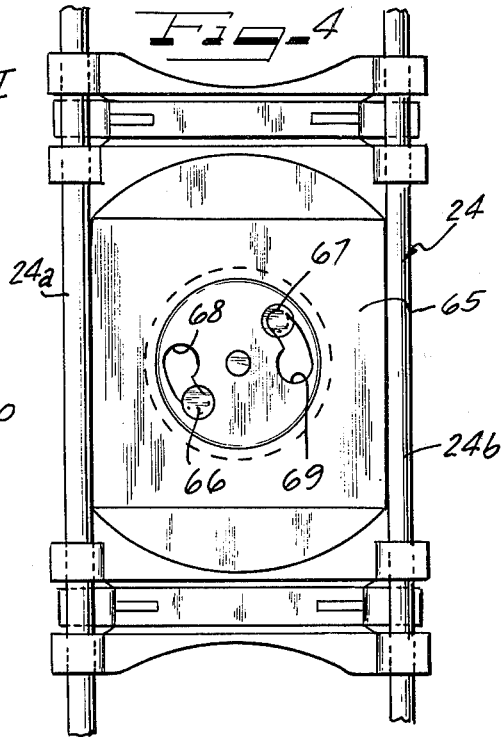
FIG. 4 is a cross-sectional view on a somewhat enlarged scale taken substantially along the line IV—IV of FIG. 3.
Figure 5:
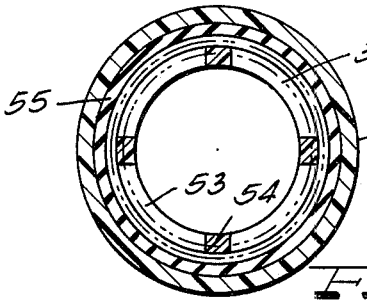
FIG. 5 is a cross-sectional view taken along the line V—V of FIG. 3.

The hub assembly is received within the rack 24 as best seen in FIG. 4 of the drawings. The hub assembly includes a support member or plate 65 adapted for mounting between adjacent wire strands 24*a* and 24*b* of the wire dish rack 24. The hub 60*a* is supported on the rack 24 by means of a pair of headed studs 66 and 67 which are locked in position with respect to keyhole slots 68 and 69, respectively. A simple twisting movement of the hub is therefore sufficient to engage or disengage the hub from the rack.

In operation, the tower assembly is initially disengaged from the upper spray arm 32 as shown in FIG. 2. When the pump 26 starts pumping wash fluid, however, wash fluid is immediately injected into the lower spray arm 30 and also serves to expand the coupling 42 into engagement with the bottom end of the tower 31. Continued application of liquid pressure forces the liquid up the column of the tower 31 and through the constricted orifice 57 in the upper tower portion. The liquid pressure then raises the telescoping upper portion 39 with respect to the fixed bottom portion 38 of the tower, causing the flange portion 56 of the telescoping portion to engage the gasket 58. The wash liquid is then directed through the hollow hub and through the apertures 62 to commence rotation of the upper spray arm 32. Under conditions of sufficient liquid pressure, the gasket 58 is deformed into sealing engagement with the flared upper end portion 56 to substantially prevent loss of liquid at this junction. Similarly, continued application of fluid pressure through the telescoping arm 39 serves to bow out the sealing member 55 into engagement or conformity with the inner periphery of the fixed outer portion 38, providing a seal against fluid leakage.

The tower structure of the present invention works equally well with adjustable upper racks as with stationary racks. In addition, with the present structure of the tower less interference is caused with the loading and unloading of the lower rack because the spray arm is a part of the upper rack and the tower is not extended during periods of loading and unloading.

It should be evident that various modifications can be made to the described embodiment without departing from the scope of the present invention.

The embodiments of the invention in which an exclusive property or privilege is claimed are defined as follows:

1. In a dishwashing appliance having upper and lower dish racks each transversely movable between loading and operating positions, a support assembly affixed to an underside of said upper rack, a rotating spray device located between said dish racks and carried rotatably upon said support assembly, and a pump for pressurizing wash liquid at an outlet thereof, a distribution system for said wash liquid comprising:

a hollow tower having a vertically fixed portion in communication with said pump outlet and receiving a flow of pressurized liquid therefrom;

a hollow movable tower portion slidably received within said fixed portion of said tower, said movable portion having at the upper end thereof flared seal means for engaging said support assembly of said spray device at a resilient cooperating gasket in said support assembly for communication of said liquid flow thereto, and a constricted orifice means for assuring pressure build-up within said movable portion sufficient to raise said movable portion to engage said support, and said movable tower portion carrying on a lower end portion thereof an annular sealing means which is sufficiently radially elastic upon exposure to pressure of said liquid flow through said portion to effect a substantially liquid-tight seal between said movable portion and said hollow tower, whereby pressurized liquid is communicated to said upper spray arm during operation of said appliance through said tower and movable portion, and said movable portion collapses in the absence of flow through said tower for movement of said upper and lower dish racks to loading positions.

2. A distribution system for wash liquid as defined in claim 1 wherein the sealing means for preventing liquid leakage between said fixed and movable tower portions comprises:

a pair of axially spaced circumferential grooves in an outer side wall of the lower end portion of the movable tower portion;

a plurality of apertures in the side wall of the movable tower portion between the circumferential grooves and spaced about the circumference of said movable tower portion; and a flexible sealing collar retained at its upper and lower ends by the pair of spaced circumferential grooves, the collar being expansible in response to liquid flow through the tower to sealingly contact the inner side wall of the fixed tower portion, whereby liquid leakage between said fixed and movable tower portions is substantially prevented during periods of liquid flow through said tower and said movable tower portion is free to move between its extended and collapsed positions in the absence of such liquid flow through said tower.

3. A wash liquid distribution system as defined in claim 1 wherein the support assembly comprises:

a horizontal surface portion; and a manifold fixed to and extending below the horizontal surface portion and including an apertured hub portion for rotatably mounting the spray device and providing liquid communication therebetween and a flange portion below said hub portion, whereby the spray device is free to rotate about the hub portion of the support assembly and is restrained between the horizontal surface portion of the support and the flange portion of the manifold to substantially prevent vertical movement of the spray device.

4. A wash liquid distribution system as defined in claim 1 wherein said flared seal means of the movable tower portion comprises a flared upper portion and an upper wall portion adjacent the base of the flared upper portion defining an opening for liquid discharge from the tower, and wherein the resilient gasket for sealingly coupling the top of the movable tower portion to the support assembly comprises a flexible diaphragm seal fixed to the flange portion of the manifold including a horizontal wall portion defining an opening in substantial alignment with the orifice in the movable tower portion, said horizontal wall portion of said diaphragm seal overlying the flared upper portion of the movable tower portion and responsive to liquid flow from said tower through said diaphragm to contact the inside wall of said flared portion and thereby effect a sealing coupling of said movable tower portion to said manifold.

5. A distribution system for wash liquid as defined in claim 1 in which said movable portion includes a pair of axially spaced grooves receiving the opposite end portions of said annular sealing means, the movable portion having apertures between said grooves communicating the fluid pressure within said telescoping portion to the expansible sealing means.

6. A wash liquid distribution system as defined in claim 1 wherein said flared seal means and said resilient gasket are sealed together by pressure forces from the flow of pressurized fluid through said tower and support assembly.

* * * * *